US011796140B1

(12) United States Patent
Kluck et al.

(10) Patent No.: US 11,796,140 B1
(45) Date of Patent: Oct. 24, 2023

(54) LIGHTING DEVICE HAVING A VIVID AND DULLING LIGHT SOURCE WITH CONTROLLED DUTY CYCLING THEREOF

(71) Applicant: Alliance Sports Group, L.P., Fort Worth, TX (US)

(72) Inventors: Wallace Andrew Kluck, Richardson, TX (US); Todd Lee Marcucci, Mansfield, TX (US)

(73) Assignee: Alliance Sports Group, L.P., Roanoke, TX (US)

( * ) Notice: Subject to any disclaimer, the term of this patent is extended or adjusted under 35 U.S.C. 154(b) by 0 days.

(21) Appl. No.: 17/888,032

(22) Filed: Aug. 15, 2022

(51) Int. Cl.

| | |
|---|---|
| ***F21V 9/00*** | (2018.01) |
| ***F21L 4/02*** | (2006.01) |
| ***F21V 9/40*** | (2018.01) |
| *F21Y 113/10* | (2016.01) |
| *F21Y 113/00* | (2016.01) |
| *H05B 45/10* | (2020.01) |

(52) U.S. Cl.
CPC ..... *F21L 4/027* (2013.01); *F21V 9/00* (2013.01); *F21V 9/40* (2018.02); *F21Y 2113/00* (2013.01); *F21Y 2113/10* (2016.08); *H05B 45/10* (2020.01)

(58) Field of Classification Search
CPC ..... F21V 9/00; F21V 9/40; F21Y 2113/00; F21Y 2113/10
See application file for complete search history.

(56) References Cited

U.S. PATENT DOCUMENTS

| | | | | |
|---|---|---|---|---|
| 7,497,590 | B2 * | 3/2009 | Rains, Jr. ..... | F21S 8/00 362/230 |
| 7,517,107 | B2 | 4/2009 | Dallas et al. | |
| 7,621,653 | B2 | 11/2009 | Hendrie | |
| 7,682,037 | B1 | 3/2010 | Hose et al. | |
| 7,988,318 | B1 | 8/2011 | Smith et al. | |
| 8,113,681 | B2 | 2/2012 | Dallas et al. | |
| 9,410,879 | B1 | 8/2016 | Hose | |

* cited by examiner

*Primary Examiner* — Robert J May
(74) *Attorney, Agent, or Firm* — Thorpe North & Western, LLP; Jed H. Hansen

(57) ABSTRACT

A lighting device is disclosed operating a vivid source having a first duty cycle and a dulling source with second duty cycle. The vivid source and the dulling source operate at alternating time intervals where the intensity of one wavelength segment or block is emphasized in the vivid source and absent or de-emphasized in the dulling source. The operation provides the user with an emphasis on objects that reflect or absorb the emphasized wavelength segment.

20 Claims, 5 Drawing Sheets

LIGHTING DEVICE HAVING A VIVID AND DULLING LIGHT SOURCE WITH CONTROLLED DUTY CYCLING THEREOF

FIELD OF THE INVENTION

The present invention relates generally to lighting devices, systems, and associated methods and more particularly to an improved apparatus and system for providing an improved lighting device for identifying objects with specific radio wavelength absorption, refraction, and/or reflection properties.

BACKGROUND

Lighting devices are commonly used for multiple purposes. However, several disadvantages in current lighting are overcome by aspects of the current technology. Including, but without limitation, the ability to better identify objects in the environment that have specific wavelength or color absorption/reflection/refraction property and the ability to optimize the attendant advantages for different users with varying degrees or capabilities of visual acuity. Other advantages are apparent in the description of aspects of the technology.

BRIEF DESCRIPTION OF THE DRAWINGS

To further clarify the above and other aspects of the present technology, a more particular description of the invention will be rendered by reference to specific aspects thereof which are illustrated in the appended drawings. It is appreciated that these drawings depict only typical aspects of the technology and are therefore not to be considered limiting of its scope. The drawings are not drawn to scale. The technology will be described and explained with additional specificity and detail through the use of the accompanying drawings in which.

DESCRIPTION OF ASPECTS

Figure 1:
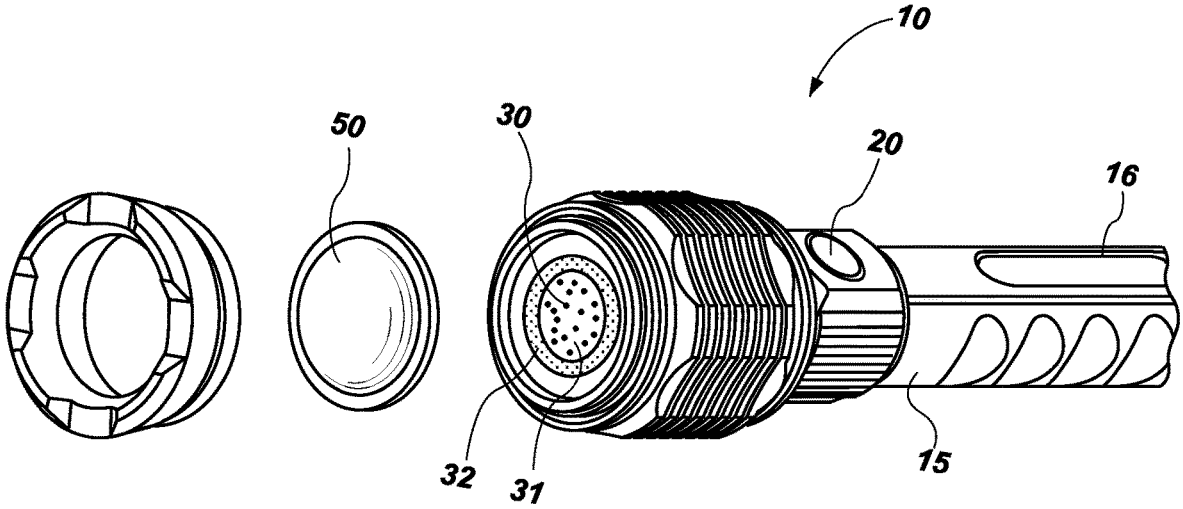
FIG. 1 is a perspective side view of a lighting device in accordance with one aspect of the technology.

Although the following detailed description contains many specifics for the purpose of illustration, a person of ordinary skill in the art will appreciate that many variations and alterations to the following details can be made and are considered to be included herein. Accordingly, the following embodiments are set forth without any loss of generality to, and without imposing limitations upon, any claims set forth. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which this disclosure belongs.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open ended term, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that any terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein. The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint. Unless otherwise stated, use of the term "about" in accordance with a specific number or numerical range should also be understood to provide support for such numerical terms or range without the term "about". For example, for the sake of convenience and brevity, a numerical range of "about 50 angstroms to about 80 angstroms" should also be understood to provide support for the range of "50 angstroms to 80 angstroms."

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Reference throughout this specification to "an example" means that a particular feature, structure, or characteristic described in connection with the example is included in at least one embodiment. Thus, appearances of the phrases "in an example" in various places throughout this specification are not necessarily all referring to the same embodiment.

Reference in this specification may be made to devices, structures, systems, or methods that provide "improved" performance. It is to be understood that unless otherwise stated, such "improvement" is a measure of a benefit obtained based on a comparison to devices, structures, systems or methods in the prior art. Furthermore, it is to be understood that the degree of improved performance may vary between disclosed embodiments and that no equality or consistency in the amount, degree, or realization of improved performance is to be assumed as universally applicable.

Example Embodiments

An initial overview of technology embodiments is provided below and specific technology embodiments are then described in further detail. This initial summary is intended to aid readers in understanding the technology more quickly, but is not intended to identify key or essential features of the technology, nor is it intended to limit the scope of the claimed subject matter.

Broadly speaking, aspects of the disclosed technology create an improved lighting apparatus and related methods that improve the ability of a user to detect objects with specific light absorption and/or reflection characteristics. In one non-limiting example, aspects of the technology improve the user's ability to observe blood in an environment exterior to the body without the need for ultraviolet light. In its barest form, aspects of the technology "dull" certain wavelengths of light within the light beam propagated from a light source. In this manner, certain objects within the beam of light are perceived by the user to be emphasized or more easily discernable. Moreover, in certain aspects of lighting technology, the ability to adjust the settings such that persons with varying degrees of visual acuity can manually change the rate or type of "dulling."

More specifically, aspects of the technology are directed towards the propagation of a plurality of wavelengths of light or "wavelength segments" or "wavelength blocks" at varying intensity levels in a "vivid" phase followed by the propagation of a plurality wavelength segments or blocks at varying intensity levels in a "dulling" phase. The vivid phase and the dulling phase are implemented at duty cycles such that when the two are juxtaposed, the human eye perceives a single coherent beam of light. In one aspect, the duty cycles are implemented in such a way that the dulling phase and the vivid phase do not substantially overlap. Meaning, generally speaking, when the vivid phase is "on" or active, the dulling phase is "off" or inactive, though in some cases there may be some overlap so long as the objective of emphasizing a target with specific wavelength properties is achieved. Moreover, in one aspect, the relative duty cycles may be adjusted by each user so that individual visual acuity levels may be matched to the individual user. Advantageously, while the relative duty cycle or intensity of the different phases may be adjusted, the ratio of intensity levels between wavelength segments or blocks in a vivid phase remains fixed. Likewise, the relative ratio of intensity levels between wavelength segments or blocks in a dulling phase remain fixed. In addition, in other aspects of the technology, the user may switch between operating modes to adjust the wavelength characteristics of the vivid and/or dulling phase whereby the wavelength segments themselves represent different wavelengths of light at the same or different intensities as other modes. But in any particular mode, as noted herein, the ratio of intensity levels between different wavelength blocks in the same phase remains fixed.

With reference now to the figures, FIG. 1 illustrates one example of a hand-held lighting device 10, though tethered devices or non-hand-held devices may be used to propagate light in accordance with aspects of the technology. The lighting device 10 generally comprises an outside housing 15 configured with a cavity for a rechargeable power source (e.g., a battery) disposed within a handle 16 of the device 10. The housing 15 further comprises a second cavity 30 with a light source 30 and a lens 50 disposed therein. In one aspect of the device, the light source 30 comprises a plurality of light emitting diodes (LEDs) and/or chip-on-board (COB) LEDs which specifically refers to LED chips in the form of a semiconductor chip that is neither encased nor connected but directly mounted onto a substrate, such as a printed circuit board (PCB). As such, a plurality of semiconductor light sources may be configured on the same substrate. In one aspect, the plurality of diodes are distributed about the light source 30 at different densities. For example, in one aspect the light source 30 comprises an inner section 31 with a plurality of LEDs at a first density and an outer section 32 with a plurality of LEDs at a second density.

While reference is made herein to COB LED lights, aspects of the technology are not limited to that specific aspect. Different LED lights/light sources may suffice so long as the light source 30 operates to provide the different wavelength blocks or segments at the duty cycles noted herein with the ratio of intensity levels herein. While the term LED is used herein in connection with a light source, it is understood that a single LED may be used as the light source or a plurality of LEDs with similar capabilities may be used. Similar LEDs may be disposed on a similar chip or substrate or they may be disposed on different chips and different substrates and disposed about different locations of the housing as suits a particular design. Meaning, LEDs with similar characteristics may be located about numerous different locations of the device. Moreover, other light sources may be used besides LEDs. It is also understood that LEDs capable of operating at different wavelengths of light or only wavelength blocks or segments may be used. In one aspect, an RGB chip is used as the light source 30. In one aspect, an RGB chip comprises three different LED emitters in one case. Each emitter is connected to a separate lead so they can be controlled independently.

In one aspect, the housing 15 further comprises a power switch 20, a control switch, and a logic controller such as a programmable logic controller or PLC. The control switch is also coupled to the PLC and permits the user to switch between different modes of operation including, but without limitation, switching between varying vivid modes and dulling modes. A PLC is a digital computer used for automation of certain electromechanical processes, such as control of machinery on factory assembly lines, amusement rides, or light fixtures. PLCs are designed for multiple arrangements of digital and analog inputs and outputs, extended temperature ranges, immunity to electrical noise, and resistance to vibration and impact. In one aspect of the technology, the instructions to control operation of the lighting device operation are stored in battery-backed-up or non-volatile memory. Memory refers to electronic circuitry that allows information, typically computer data, to be stored and retrieved.

As will be appreciated by one skilled in the art, aspects of the present technology may be embodied as a system, method or computer program product used in connection with a lighting device. Accordingly, aspects of the present technology may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a random access memory (RAM), a read-only memory (ROM), an erasable programmable read-only memory (EPROM or Flash memory), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing. Computer program code for carrying out operations for aspects of the present technology may be written in any combination of one or more programming languages, including an object-oriented programming language such as Java, Visual Basic, SQL, C++ or the like and conventional procedural programming languages, such as the "C" programming language or similar programming languages.

In one aspect of the technology, the light sources or LEDs are configured with pulse-width modulation ("PWM") to regulate the brightness or dimness of specific LED lights. PWM is one way of regulating the brightness of a light. Thus, for one phase a user may select a first PWM mode and in a different phase a user may select a second PWM mode such that different LED lights on the same chip (or different chips) have different levels of dimness or brightness. In one aspect, light emission from the LED is controlled by pulses wherein the width of these pulses is modulated to control the amount of light perceived by the end user. When the full direct current voltage runs through an LED, the maximum of light is emitted 100% of the time. That is, the LED emits light 100% of the time when in an "on" mode. With PWM, the voltage supplied to the LED can be "on" 50% of the time and "off" 50% of the time so that the LED gives off its maximum amount of light only 50% of the time. This is referred to as a 50% duty cycle. In this scenario, if the on-off cycle is modulated fast enough, human eyes will perceive only half the amount of light coming from the LED. That is, with such an input on the LED, the amount of light given off appears diminished by 50%. While specific reference is made to a 50% duty cycle, the LED duty cycle of the light source described herein may be greater or lesser than 50% as suits a particular purpose. For example, the LED(s) propagating light at different wavelength segments (an LED "vivid block" and/or LED "dulling block") may have a duty cycle that ranges from 25% to 40%, 40% to 50%, 50% to 60%, and/or 60% to 75%. They may also have duty cycles that range from 20% to 25%, 25% to 30%, 30% to 35%, 35% to 40%, 40% to 45%, 45% to 50%, 50% to 55%, 55% to 60%, 60% to 65%. 65% to 70%, 70% to 75%, 75% to 80%, 80% to 85%, 85% to 90%, 90% to 95%, and/or 95% to 100%. The range may of course include more than the ranges provided herein and may include a greater range or a smaller range.

In one aspect of the technology, the on-off cycle (i.e., the rate at which the LEDs in a vivid phase and/or dulling phase are turned on and off) is greater than about 8 to about 10 KHz. In another aspect of the technology, the on-off cycle ranges from about 1 to about 8 KHz. In another aspect, the on-off cycle ranges from about 0.001 KHz to about 1 KHz. In yet another example, the on-off cycle ranges from about 0.002 to 0.004 KHz. In one aspect, the on-off cycle for the vivid phase and dulling phase are substantially the same. However, in one aspect the vivid phase has an on-off cycle greater than the dulling phase and vice versa.

In one aspect, light source 30 is configured to operate with a preset plurality of duty cycles. Meaning, the vivid source operates at a first duty cycle (e.g., 25%, 50%, etc.) for a first period of time (e.g., 5s, 10s, 15s, etc.) and the dulling source operates at a second duty cycle (e.g., 25%, 50%, etc.) for a second period of time (e.g., 5s, 10s, or 15s, etc.). In one aspect, the length of first and second periods of time (i.e., the vivid interval and dulling interval) are substantially the same. In another aspect, however, the length of the respective intervals are different. Meaning, the vivid interval may be greater than the dulling interval or vice versa. In one aspect of the technology, time period over which the first time interval and the second time interval operate are separate from one another. In other words, they do not overlap. For example, the first time interval may begin at time Os and end at time 5s wherein the second time interval may begin at time 5s (or 5.01s) and end at time 10.01s. However, in other aspects of the technology, the time intervals may overlap. For example, the first time interval may begin at time Os and end at time 5s wherein the second time interval may begin at time 4.5s and end at time 9.5s.

It is important to note that while reference is made herein to a vivid source of LEDs and a dulling source of LEDs, the vivid source and dulling source are not required to be different LEDs. In one aspect of the technology, the vivid source and dulling source may be the same LEDs capable of propagating light at the different wavelength segments disclosed. In another aspect, the vivid source and dulling source are different LEDs. In another aspect, the vivid source and dulling source may share some LEDs while also having separate LEDs in their respective sources.

In another aspect of the technology, the lighting devices comprise LEDs wherein a first frequency of light (or wavelength block or segment) is propagated from the LEDs for a first period of time (e.g., 5s, 10s, or 15s), a second frequency of light (or wavelength block or segment) is propagated from the LEDs for a second period of time, and a third frequency of light (or wavelength block or segment) is propagated from the LEDs for a third period of time. The first, second, and third periods of time may be the same, or they may be different as suits a particular purpose. There may be some overlap between the different time periods or they may be no overlap as suits a particular purpose. In an additional aspect, the different frequencies are propagated from different LEDs and not necessarily from the same LED or the same group of LEDs. For example, in one aspect, light is propagated from the vivid source at 440-460 nm for 0.05 seconds, at 510-540 nm for 0.05 seconds, and then 640-660 nm for 0.05 seconds in series for 0.3 seconds. In another aspect, light is propagated from the vivid source at 440-460 nm for 0.05 seconds, at 510-540 nm for 0.05 seconds, and then 640-660 nm for 0.08 seconds for 0.36 seconds. That pattern is repeated for a period of time in a predetermined or user-selected duty-cycle juxtaposed with light propagated from the dulling source.

With reference to FIGS. 2-5, different non-limiting examples of vivid and dulling spectra are disclosed in accordance with different aspects of the technology. FIG. 2*a* discloses a plurality of wavelength segments or blocks of the vivid spectrum comprising a first vivid wavelength segment or block 40 ranging from about 440-460 nm, a second vivid wavelength or block 41 ranging from about 510-540 nm, and a third vivid wavelength segment or block 42 ranging from about 640-660 nm. FIG. 2*a* also discloses the relative intensity of the different segments to one another. For example, the relative intensity of the first and second segments 40. 41 are substantially the same. However, the third block 42 has a greater intensity than the first and second blocks. In the example in FIG. 2*a*, the intensity is not shown in any particular unit of measure. Rather, it is disclosed as a ratio of intensity with respect to one another. In the vivid spectrum disclosed in FIG. 2*a*, for example, the first and second wavelength segments 40, 41 are about 0.75 the intensity of the third block 42. In one aspect of the technology, if the intensity of the light propagated from the vivid source is increased or decreased, the relative ratio of the intensities of the different wavelength segments or blocks within the vivid spectrum to one another remains the same.

Figure 2A:
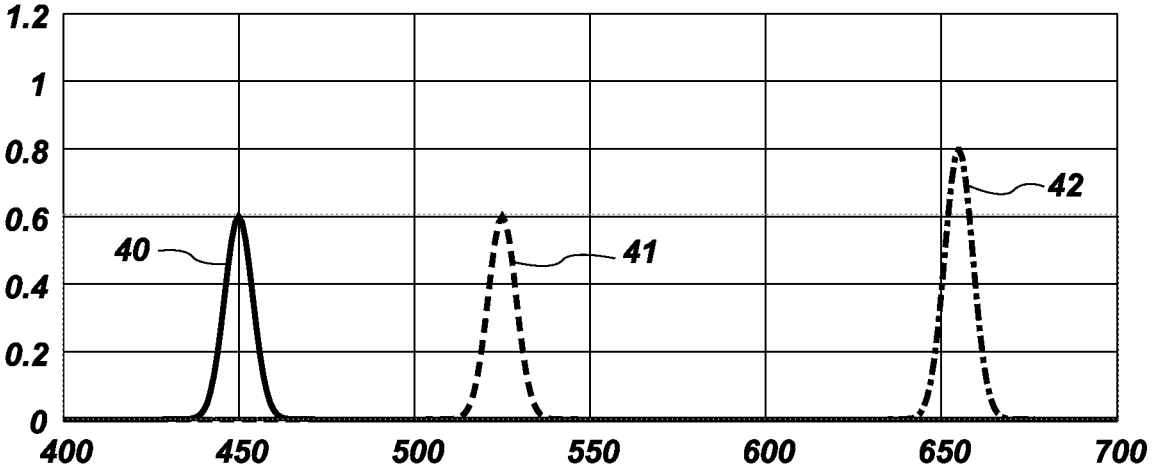
FIG. 2*a* is a graph of different vivid spectrums of wavelength blocks in accordance with one aspect of the technology.
Figure 2B:
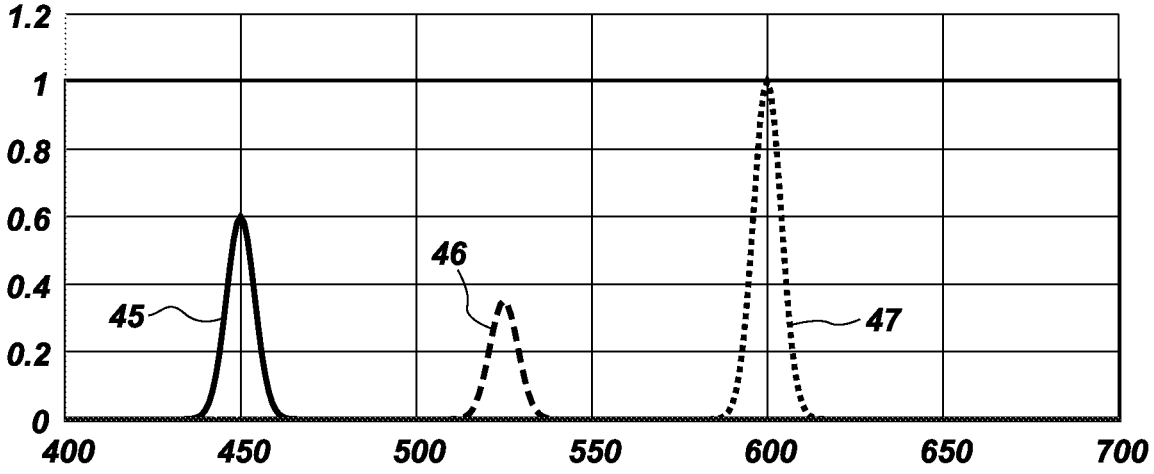
FIG. 2*b* is a graph of different dulling spectrums of wavelength blocks in accordance with one aspect of the technology used in conjunction with the vivid spectrum of FIG. 2*a;*

In the dulling spectrum disclosed in FIG. 2*b* comprises a plurality of wavelength segments comprising a first dulling wavelength segment or block 45 ranging from about 440-460 nm, a second dulling wavelength or block 46 ranging from about 510-540 nm, and a third dulling wavelength segment or block 47 ranging from about 590-610 nm. The relative intensity of the first 45, second 46, and third 47 dulling segments or blocks to one another are all different. Specifically, the intensity of the first dulling wavelength segment 45 is about 0.6 (or between about 0.55 and 0.65) of the intensity of the third dulling wavelength segment 47. The second dulling wavelength segment 46 is about 0.375 (or between about 0.3 and 0.4) of the intensity of the third dulling segment 47. As with the vivid spectrum, in one aspect of the technology, if the intensity of the light propagated from the dulling spectrum is increased or decreased, the relative ratio of the intensities of the different wavelength segments within the dulling spectrum remains the same.

Figure 3A:
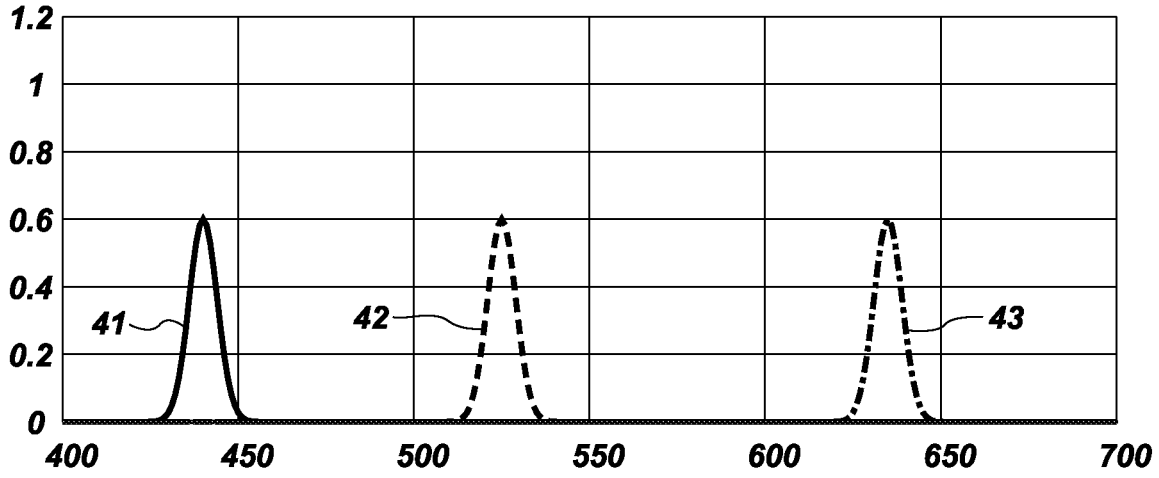
FIG. 3*a* is a graph of different vivid spectrums of wavelength blocks in accordance with one aspect of the technology.
Figure 3B:
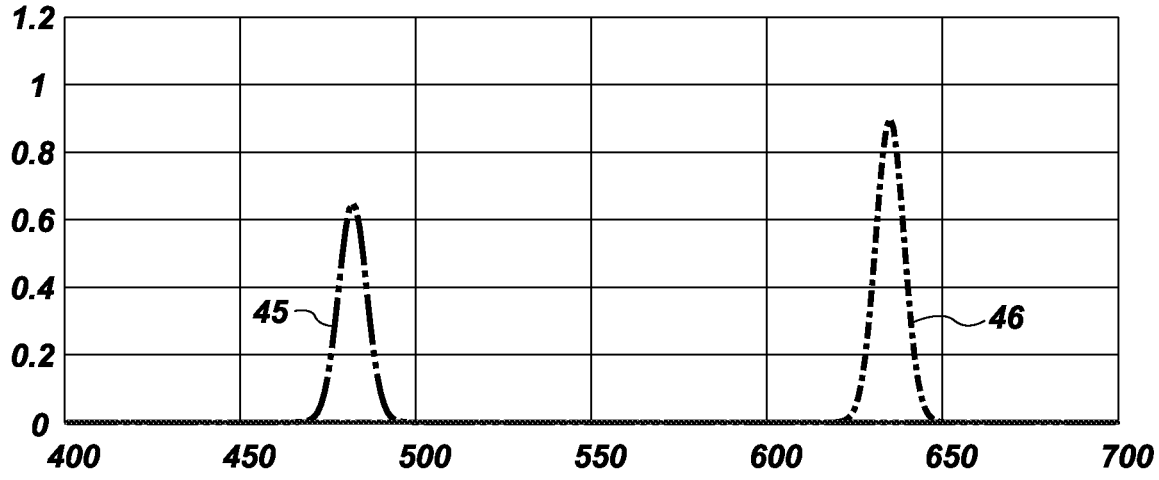
FIG. 3*b* is a graph of different dulling spectrums of wavelength blocks in accordance with one aspect of the technology used in conjunction with the vivid spectrum of FIG. 3*a;*

While specific wavelength ranges or segments are disclosed, it is understood that different wavelength segments (vivid and/or dulling) can be used so long as the wavelengths combine to have the appearance of a general white light wherein the vivid phase or vivid spectra is configured to emphasize a particular wavelength block associated with a target that has specific color absorption/reflection properties in view of the dulling phase or dulling spectra. For example, in another aspect of the technology, with reference to FIG. 3*a*, a plurality of wavelength segments of the vivid spectrum is shown comprising a first vivid wavelength segment 41 ranging from about 440-460 nm, a second vivid wavelength segment 42 ranging from about 510-540 nm, and a third vivid wavelength segment 43 ranging from about 630-650 nm. FIG. 3 also discloses the relative intensity of the different segments to one another. In this aspect, the relative intensity of the first, second, and third wavelength segments of the vivid spectrum are substantially the same. In accordance with one aspect of the technology, the dulling spectrum disclosed in FIG. 3*b* comprises a plurality of dulling wavelength segments comprising a first dulling wavelength segment 45 ranging from about 470-490 nm and a second dulling wavelength segment 46 ranging from about 630-650 nm. The relative intensity of the first dulling segment 45 to the second dulling segment 46 is about 0.67 (or between about 0.6 and 0.7). As with the vivid source or full spectrum, in one aspect of the technology, if the intensity of the light propagated from the dulling source or full spectrum is increased or decreased, the relative ratio of the intensities of the different wavelength segments or blocks in the entire dulling source or spectrum remains the same. Meaning, the intensity of all wavelength segments in the vivid source or spectrum may be increased or decreased by the end user, but the ratio of the intensity amongst the different wavelength segments remains the same. Likewise, the intensity of all wavelength segments in the dulling source or spectrum may be increased or decreased by the end user, but the ratio of the intensity amongst the different wavelength segments remains the same.

Figure 4A:
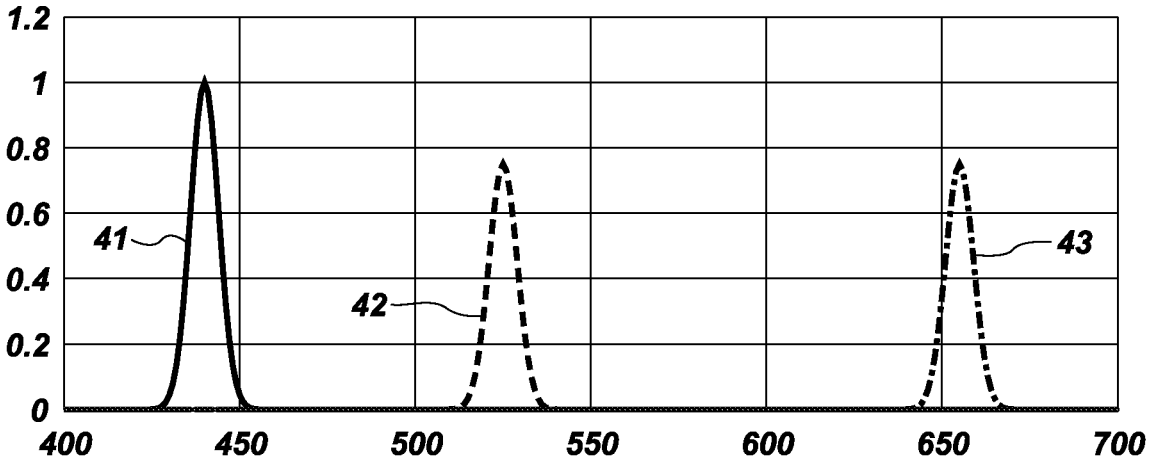
FIG. 4*a* is a graph of different vivid spectrums of wavelength blocks in accordance with one aspect of the technology.
Figure 4B:
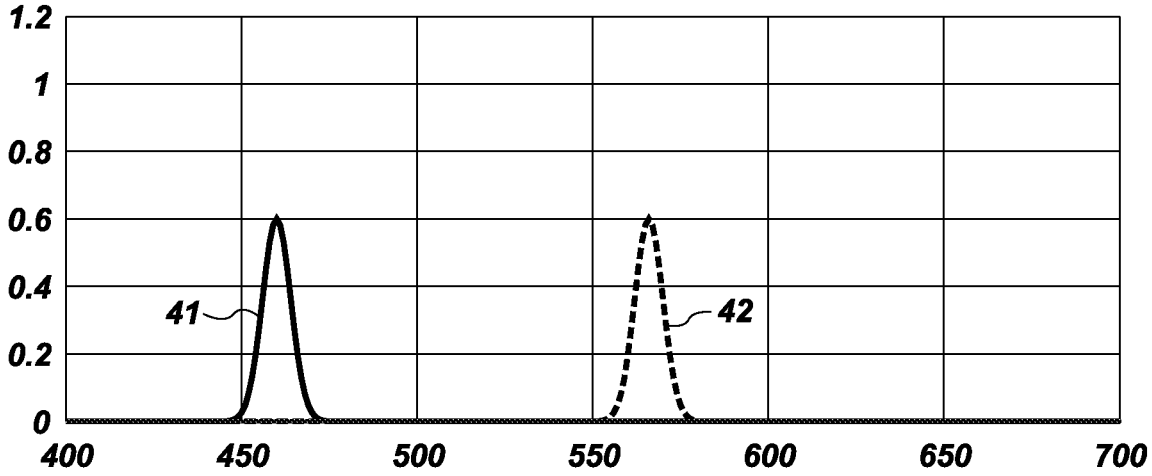
FIG. 4*b* is a graph of different dulling spectrums of wavelength blocks in accordance with one aspect of the technology used in conjunction with the vivid spectrum of FIG. 4*a;*

In one aspect of the technology, with reference to FIG. 4*a*, a plurality of wavelength segments of the vivid spectrum or vivid source is shown comprising a first vivid wavelength segment or block 41 ranging from about 430-450 nm, a second vivid wavelength segment or block 42 ranging from about 520-540 nm, and a third vivid wavelength segment or block 43 ranging from about 640-670 nm. FIG. 4*a* also discloses the relative intensity of the different wavelength segments to one another. In this aspect, the relative intensity of the second and third wavelength segments 42, 43 of the vivid spectrum are substantially the same and are about 0.75 (or between about 0.7 and 0.8) of the intensity of the first vivid wavelength segment 41. In accordance with one aspect of the technology, the dulling spectrum disclosed in FIG. 4*b* comprises a plurality of wavelength segments comprising a first dulling wavelength segment or block 45 ranging from about 450-470 nm and a second dulling wavelength segment or block 46 ranging from about 560-580 nm. The relative intensity of the first and second dulling wavelength segments 45, 46 is approximately the same.

Figure 5A:
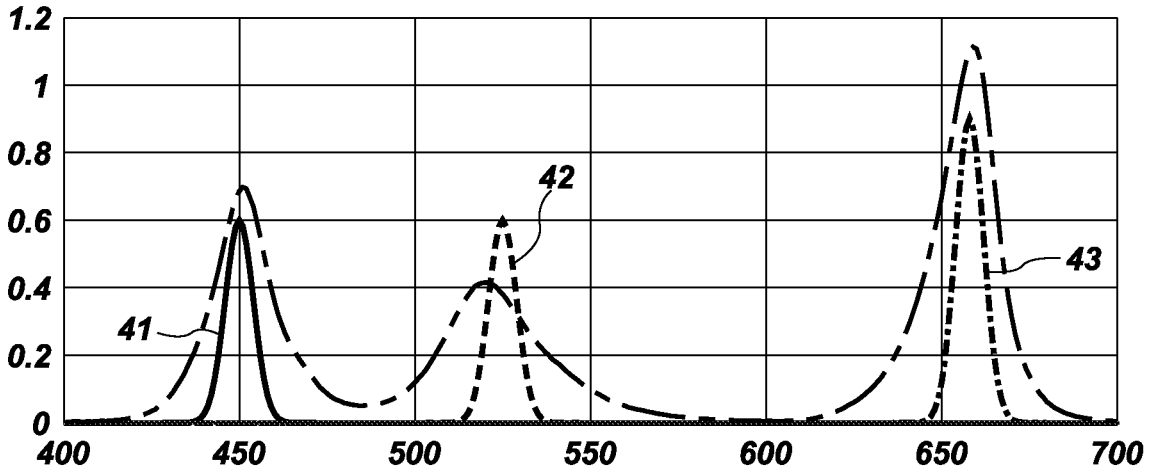
FIG. 5*a* is a graph of different vivid spectrums of wavelength blocks in accordance with one aspect of the technology.
Figure 5B:
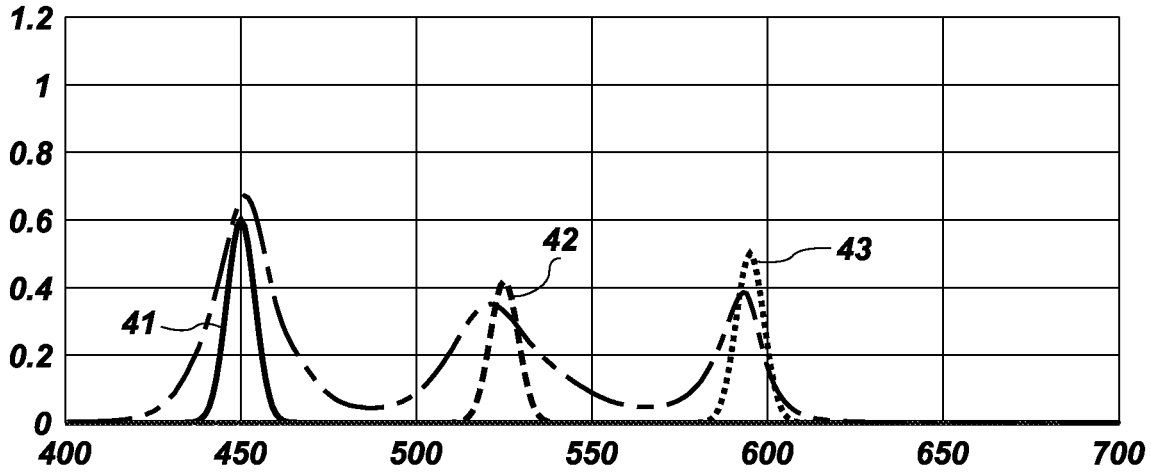
FIG. 5*b* is a graph of different dulling spectrums of wavelength blocks in accordance with one aspect of the technology used in conjunction with the vivid spectrum of FIG. 5*a.*

In one aspect of the technology, with reference to FIG. 5*a*, a plurality of wavelength segments of the vivid spectrum is shown comprising a first vivid wavelength segment 41 ranging from about 430-450 nm, a second vivid wavelength segment 42 ranging from about 520-540 nm, and a third vivid wavelength segment 43 ranging from about 650-670 nm. In this aspect, the relative intensity of the first and second wavelength segments 42, 43 of the vivid spectrum are substantially the same and are about 0.75 (or between about 0.7 and 0.8) of the intensity of the third vivid wavelength segment 43. In accordance with one aspect of the technology, the dulling spectrum disclosed in FIG. 5*b* comprises a plurality of wavelength segments comprising a first dulling wavelength segment or block 45 ranging from about 440-460 nm, a second dulling wavelength segment or block 46 ranging from about 560-580 nm, and a third dulling wavelength segment or block 47 ranging from about 580-605 nm. The intensity of the second dulling wavelength segment 46 to the first dulling wavelength segment 45 is approximately 0.67 (or between about 0.6 and 0.7). The intensity of the third dulling wavelength segment 47 to the first dulling wavelength segment 45 is approximately 0.83 (or between about 0.8 and 0.9).

In another aspect of the technology, a plurality of wavelength segments of the vivid spectrum comprises a first vivid wavelength segment or block ranging from about 450-480 nm, a second vivid wavelength segment or block ranging from about 490-560 nm, and a third vivid wavelength segment or block ranging from about 650-680 nm. In this aspect, the relative intensity of the first vivid wavelength segment to the second vivid wavelength segment of the vivid spectrum is about 0.75 (or between about 0.7 and 0.8). The ratio of intensity between the second vivid wavelength segment or block to the third vivid segment or block is about 0.3 (or between about 0.25 and 0.35). In accordance with one aspect of the technology, the dulling spectrum comprises a plurality of wavelength segments comprising a first dulling wavelength segment or block ranging from about 450-480 nm, a second dulling wavelength segment or block ranging from about 490-560 nm, and a third dulling wavelength segment or block ranging from about 580-610 nm. The intensity of the second dulling wavelength segment to the first dulling wavelength segment is approximately 0.67 (or between about 0.6 and 0.7). The intensity of the third dulling wavelength segment to the first dulling wavelength segment is approximately 0.83 (or between about 0.8 and 0.9).

In one aspect of the technology, the first vivid wavelength segment in the vivid phase is the substantially the same as the first dulling wavelength segment in the dulling phase. The intensity of the first wavelength segment of the vivid phase, however, is less than the intensity of the first wavelength segment of the dulling phase. That is, the intensity of the first vivid wavelength segment or block is less than the intensity of the first dulling wavelength segment or block. In another aspect, the second wavelength segment in the vivid phase is the substantially the same as the second wavelength segment in the dulling phase. The intensity of the second wavelength segment of the vivid phase is substantially the same as the intensity of the second wavelength segment of the dulling phase. The third wavelength segment in the vivid phase is targeted to emphasize a red colored target, the third wavelength segment in the dulling phase having a different wavelength segment but being similar to the third wavelength segment of the vivid phase. In one aspect, the intensity of third wavelength segment of the vivid phase is substantially higher than the intensity of the third wavelength segment of the dulling phase. In this manner, the red properties of the target are emphasized. While specific examples or provided, it is understood that different combinations and arrangements of dulling and vivid wavelength segments or blocks are within the scope of the technology so long as the target object is emphasized within the aggregated beam of light emanating from the lighting device 30.

It is believed that different end users have different visual acuity. As such, no single configuration of a vivid phase and dulling phase will be optimal for all end users. Moreover, no single duty cycle for a vivid phase and dulling phase or intensity level will be optimal for all end users. In accordance with aspects of the technology, the lighting device 30 is configured to allow the user to variably adjust the intensity of the dulling phase and/or vivid phase either through manipulation of the voltage or amperage being relayed to the vivid and/or dulling sources or an increase of the relative number of LEDs operating in any one particular source. In another aspect of the technology, the end user selects amongst a plurality of preset levels of vivid intensity and/or dulling intensity. The term intensity used herein refers to the amount of light (lumens) falling on a surface over any given square foot or square meter, for example. It can be measured in foot-candles or lux.

In accordance with other aspects of the technology, the lighting device 30 is configured to allow the user to variably adjust the duty cycle of the vivid phase and/or dulling phase to optimize the visual acuity of the end user. In another aspect of the technology, the end user selects amongst a plurality of preset levels of vivid and/or dulling duty-cycles. In another aspect of the technology, the lighting device 30 is configured with a plurality of preset vivid/dulling spectra combinations that the user may select from. In this manner, more than one target may be viewed depending on the wavelength absorption/reflection characteristics. Likewise, again due to the different visual acuity of end users, a plurality of different vivid/dulling spectra combinations that are tuned to emphasize one object is contemplated. For example, in accordance with one aspect of the technology, a lighting device may have a "blood" setting and/or a "foliage" setting. In one aspect, the blood setting, for example, has a plurality of preset vivid and dulling wavelength segments that the user may select; the different presets configured to optimize the spectra of light associated with blood identification by the human eye within the normal visible spectrum of light (though UV wavelengths of light may also be used). Each of the wavelength segment presets may be modified to have a different duty cycle. Meaning, the vivid phase duty cycle may be adjusted up or down and the dulling phase duty cycle may be adjusted up or down. In addition, the intensity of light propagated from the vivid block and/or the dulling block may be adjusted up or down, constrained by maintenance of the intensity ratio between wavelength segments in the same block. In a "foliage" setting, duty cycles and intensity levels can likewise be adjusted up or down but the wavelength segments would be optimized to optimize spectra of light associated with foliage identification by the human eye within the normal visible spectrum of light (though infrared wavelengths of light could also be used).

In one aspect of the technology, the lights source 30 requires a driver in order to provide/deliver a desired output. The driver may be internally or externally incorporated into the light source 30 and can be either constant current or constant voltage. Both constant current and constant voltage drivers act as a power supply for the light source 30. Drivers provide and regulate the necessary voltage in order to maintain operation of the light source 30. In one aspect of the technology, a constant current driver operates within a range of output voltages and a fixed output current (amps). Light source 30 can have LEDs rated to operate at a forward voltage with an associated current, and a supply is needed to deliver the required operational voltage and current. In one aspect, a constant current driver varies the voltage along an electronic circuit which allows a constant electrical current through the light source 30. In one aspect of the technology, a constant voltage driver operates on a single direct current (DC) output voltage (e.g., 12 VDC or 24 VDC, etc.). The driver will maintain a constant voltage no matter the load current. In one aspect of the technology, the power mode of the lighting device may be changed by changing the current that is available from the light source drive circuitry. In one aspect of the technology, an electronic circuit comprises an overall voltage supply that is high enough to span a number of LEDs in series (e.g., 3.2V is a forward voltage rating for different LEDs, etc.), and a 10 Ohm resistor component is used to set the desired current. By varying the resistor, brightness of the LEDs is varied up to the forward current limitation of the light source 30. Of course, different forward voltage ratings and different resistors, or other circuit components, may be used as a means of regulating constant current in a light source 30.

It is noted that no specific order is required in these methods unless required by the claims set forth herein, though generally in some embodiments, the method steps can be carried out sequentially. In one aspect, a method of operating a light source comprises activating a vivid light source disposed about a head of the device and concurrently propagating a plurality of vivid wavelength segments away from the head of the device, the vivid light source having a duty cycle less than 100%. It also comprises activating a dulling light disposed about a head of the device and concurrently propagating a plurality of dulling wavelength segments away from the head of the device at a time interval different from the vivid light source such that the dulling light and the vivid light do not overlap, the dulling light source having a duty cycle less than 100%. At least one of the plurality of vivid wavelength segments is configured to target an object characterized by the ability of that object to reflect at least one of the plurality of vivid wavelength segments. In one aspect, none of the plurality of dulling wavelength segments are configured to target the object characterized by the ability to reflect at least one of the plurality of vivid wavelength segments.

In one aspect of the technology, the method further comprises adjusting the duty cycle of the vivid light source up or down while maintaining a ratio of intensity between each of the plurality of vivid wavelength segments. It also comprises adjusting the duty cycle of the dulling light source up or down while maintaining a ratio of intensity between each of the plurality of dulling wavelength segments. In another aspect, the method comprises adjusting the intensity of the vivid light source up or down while maintaining a ratio of intensity between each of the plurality of vivid wavelength segments. Likewise, the method further comprises adjusting the intensity of the dulling light source up or down while maintaining a ratio of intensity between each of the plurality of dulling wavelength segments. In another aspect, the method further comprises adjusting the length of the first time interval and the second time interval, or adjusting the length of the first time interval or the length of the second time interval.

The foregoing detailed description describes the technology with reference to specific exemplary aspects. However, it will be appreciated that various modifications and changes can be made without departing from the scope of the present technology as set forth in the appended claims. The detailed description and accompanying drawing are to be regarded as merely illustrative, rather than as restrictive, and all such modifications or changes, if any, are intended to fall within the scope of the present technology as described and set forth herein.

More specifically, while illustrative exemplary aspects of the technology have been described herein, the present technology is not limited to these aspects, but includes any and all aspects having modifications, omissions, combinations (e.g., of aspects across various aspects), adaptations and/or alterations as would be appreciated by those skilled in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus-function are expressly recited in the description herein. Accordingly, the scope of the invention should be determined solely by the appended claims and their legal equivalents, rather than by the descriptions and examples given above.

The invention claimed is:

1. A lighting device, comprising:

a light source disposed about a distal end of the lighting device, the light source comprising a vivid source operating at a first duty cycle and a dulling source operating at a second duty cycle;

wherein the vivid source is configured to operate in a vivid phase comprising concurrent propagation of a plurality of vivid wavelength segments;

wherein the intensity of each of the plurality of vivid wavelength segments are different from one another;

wherein the dulling source is configured to operate in a dulling phase comprising concurrent propagation of a plurality of dulling wavelength segments;

wherein the intensity of each of the plurality of dulling wavelength intensities are different from one another;

wherein at least one of the plurality of vivid wavelength segments and one of the plurality of dulling wavelength segments do not have overlapping wavelength ranges; and wherein the vivid phase propagates light at a first time interval and the dulling phase propagates light at a second time interval, wherein the first time interval and the second time interval do not substantially overlap.

2. The lighting device of claim 1, wherein the length of the first time interval and the length of the second time interval or substantially the same.

3. The lighting device of claim 1, wherein the first time interval and the second time interval alternate at intervals ranging from 0.1 to 0.2 seconds.

4. The lighting device of claim 1, wherein the vivid phase comprises a duty cycle ranging from between 40% and 60% and the dulling phase ranges between 40% and 60%.

5. The lighting device of claim 1, further comprising a power source coupled to the light source and a control circuit coupled to the power source; wherein the control circuit comprises instructions to allow the lighting device to increase or decrease the intensity level of the vivid phase while maintaining the ratio of intensity between different vivid wavelength segments.

6. The lighting device of claim 1, further comprising a power source coupled to the light source and a control circuit coupled to the power source; wherein the control circuit comprises instructions to allow the lighting device to increase or decrease the intensity level of the dulling phase while maintaining the ratio of intensity between different dulling wavelength segments.

7. The lighting device of claim 1, wherein the lighting device comprises a control circuit with instructions to allow the user to increase or decrease the duty cycle of the vivid phase while maintaining the ratio of intensity between different vivid wavelength segments.

8. The lighting device of claim 1, further comprising a power source coupled to the light source and a control circuit coupled to the power source; wherein the control circuit comprises instructions to allow the lighting device to increase or decrease the intensity level of the dulling phase while maintaining the ratio of intensity between different dulling wavelength segments.

9. A lighting device, comprising:

a light source disposed about a lighting device comprising a control circuit coupled to a power source, the light source comprising a vivid light source and a dulling lighting source;

wherein each of the vivid light source and dulling light source having a duty cycle ranging from between 25% and 75%;

wherein the vivid source is configured to operate in a vivid phase comprising concurrent propagation of a first vivid wavelength segment, a second vivid wavelength segment, and a third vivid wavelength segment, wherein a ratio of the intensity between the first, second, and third vivid wavelength segments is substantially constant;

wherein the dulling block is configured to operate in a dulling phase comprising concurrent propagation of a dulling first wavelength segment, a dulling second wavelength segment, and a dulling third wavelength segment, wherein a ratio of the intensity between the first, second, and third dulling wavelength segments is substantially constant;

wherein the third wavelength segment of the dulling phase is different than the third wavelength segment of the vivid phase; and wherein the vivid phase propagates light at a first time interval and the dulling phase propagates light at a second time interval.

10. The lighting device of claim 9, wherein the third wavelength segment of the vivid phase ranges from between 640 nm to about 680 nm.

11. The lighting device of claim 10, wherein the third wavelength segment of the dulling phase ranges from between 640 nm to about 680 nm but has a different level of intensity as the third wavelength segment of the vivid phase.

12. The lighting device of claim 10, wherein the third wavelength segment of the dulling phase ranges from between 580 nm to about 610 nm.

13. The lighting device of claim 9, wherein the duty cycle of the vivid phase is adjustable in 10% increments from about 40% to about 60% and the duty cycle of the dulling phase is adjustable in 10% increments from about 40% to about 60%.

14. The lighting device of claim 9, wherein the length of the first time interval and the length of the second time interval are adjustable in 0.1 second increments ranging from about 0.1 second to about 0.5 seconds.

15. A method of propagating light with a device:

activating a vivid light source disposed about a head of the device and concurrently propagating a plurality of vivid wavelength segments away from the head of the device, the vivid light source having a duty cycle less than 100%;

activating a dulling light disposed about a head of the device and concurrently propagating a plurality of dulling wavelength segments away from the head of the device at a time interval different from the vivid light source such that the dulling light and the vivid light do not overlap, the dulling light source having a duty cycle less than 100%;

wherein at least one of the plurality of vivid wavelength segments is configured to target an object characterized by the ability of that object to reflect at least one of the plurality of vivid wavelength segments;

wherein none of the plurality of dulling wavelength segments are configured to target the object characterized by the ability to reflect at least one of the plurality of vivid wavelength segments.

16. The method of claim 15, further comprising adjusting the duty cycle of the vivid light source up or down while maintaining a ratio of intensity between each of the plurality of vivid wavelength segments.

17. The method of claim 15, further comprising adjusting the duty cycle of the dulling light source up or down while maintaining a ratio of intensity between each of the plurality of dulling wavelength segments.

18. The method of claim 15, wherein the duty cycle of the vivid phase is adjustable in 10% increments from about 40% to about 60% and the duty cycle of the dulling phase is adjustable in 10% increments from about 40% to about 60%.

19. The method of claim 15, further comprising adjusting the length of the first time interval and the second time interval, or adjusting the length of the first time interval or the length of the second time interval.

20. The method of claim 15, wherein the length of the first time interval and the length of the second time interval are adjustable in 0.1 second increments ranging from about 0.1 second to about 0.5 seconds.

* * * * *